US005303927A

United States Patent [19]

Perry et al.

[11] Patent Number: 5,303,927

[45] Date of Patent: Apr. 19, 1994

[54] GOLF SWING TRAINING DEVICE AND METHOD

[75] Inventors: Carl L. Perry, Lighthouse Point; L. Gregory Johnson, Ft. Lauderdale, both of Fla.

[73] Assignee: J. David Eller, Deerfield Beach, Fla. ; a part interest

[21] Appl. No.: 966,000

[22] Filed: Oct. 23, 1992

[51] Int. Cl.[5] ..... A63B 69/36

[52] U.S. Cl. ..... 273/188 R; 482/124

[58] Field of Search ..... 273/187.2, DIG. 63, 273/188 R, 188 A, 189 R, 190 R, 190 B, 190 A; 434/252; 482/124, 130, 74

[56] References Cited

U.S. PATENT DOCUMENTS

| | | | |
|---|---|---|---|
| 2,498,006 | 2/1950 | Ridill | 273/189 |
| 2,773,691 | 12/1956 | Redfield | 273/189 |
| 2,893,736 | 7/1959 | Tesi | 273/188 |
| 3,870,317 | 3/1975 | Wilson | 273/188 R |
| 3,940,144 | 2/1976 | Dickie | 273/183 B |
| 4,134,589 | 1/1979 | Arena | 273/183 B |
| 4,593,909 | 6/1986 | Anselmo et al. | 273/188 R |
| 4,955,608 | 9/1990 | Dougherty et al. | 2783/29 A |
| 5,048,836 | 9/1991 | Bellagamba | 273/187.2 |
| 5,062,642 | 11/1991 | Berry et al. | 273/183 B |
| 5,188,366 | 2/1993 | Dorotinsky et al. | 273/188 R |
| 5,209,482 | 5/1993 | Hopfer | 273/187.2 |

*Primary Examiner*—George J. Marlo
*Attorney, Agent, or Firm*—Oltman and Flynn

[57] ABSTRACT

A golf training device for a golf player including a hip belt having opposite belt ends, belt closing elements on the belt for holding the belt ends in joined position on the player, an elastic cord having an upper end and a lower end, an elastic cord attachment point on the belt disposed substantially opposite the joined position, and a stirrup attached to the lower end of the elastic cord for receiving a foot of the golf player.

The length of the elastic cord is such that the stretched cord extends from the stirrup receiving the player's foot laterally and upwardly over the front and to the rear of the player to its attachment point on the belt thereby creating a rotational torque at the hips of the player which assists the player in maintaining a proper body stance throughout the swing with a club and properly turning the hips as required for a proper swing.

7 Claims, 2 Drawing Sheets

GOLF SWING TRAINING DEVICE AND METHOD

The invention relates to golf training devices, and more particularly to a golf training device for helping a golf player to maintain a proper body stance throughout the swing with a club, and to perform hip rotation as required for a perfect swing.

BACKGROUND AND PRIOR ART

In striking a golf ball it has been found to be very important that the player rotates the hips during the swing in conformance with the driving force being applied to the golf club.

Several golf training devices are known as aids in maintaining the proper stance and motion of limbs during the stroke for the best possible performance in driving the ball.

As an example, U.S. Pat. No. 3,940,144 shows a device composed of a belt and a non-stretching cord attached to the belt at opposite sides and looped under the player's feet to help the player maintain a proper stance during a swing. This patent, however does not meet the object of assisting the player in performing the proper turning of the hips as described above. U.S. Pat. No. 2,498,006 shows an elastic cord for attachment between a player's hands and a foot for the purpose of training the player in the use and control of the left arm and left side of a right-handed player during the swing. Again, this device does not meet the object of inducing the player to perform the proper turning of the hips during the swing.

It is accordingly an important object of the invention to provide a golf training aid that helps the golf player to practice maintaining a proper stance throughout the swing of the golf club and particularly so that he or she maintains a stance with the right side straight and helps to rotate the body in the hips during the swing.

SUMMARY OF THE INVENTION

According to the invention there is provided a golf training device for a golf player including a hip belt having opposite belt ends, belt closing means on the belt for holding the belt ends in joined position on the player, an elastic cord having an upper end and a lower end, an elastic cord attachment point on the belt disposed substantially opposite the joined position, and a stirrup attached to the lower end of the elastic cord for receiving a foot of the golf player.

The invention may further include a golf training device including hook and loop fasteners in the belt closing means attached to respective opposite ends of the hip belt, and may further include two mating belt buckle parts in the belt closing means attached to respective opposite ends of the hip belt.

According to a further feature the elastic cord has a length in stretched condition substantially equal to the distance between the left foot of the player and the elastic cord attachment point with a right-handed player in a stance beginning the swing, or wherein the elastic cord has a length in stretched condition substantially equal to the distance between the right foot of the player and the elastic cord attachment point with a left-handed player in a stance beginning the swing.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Figures 1A, 1B:
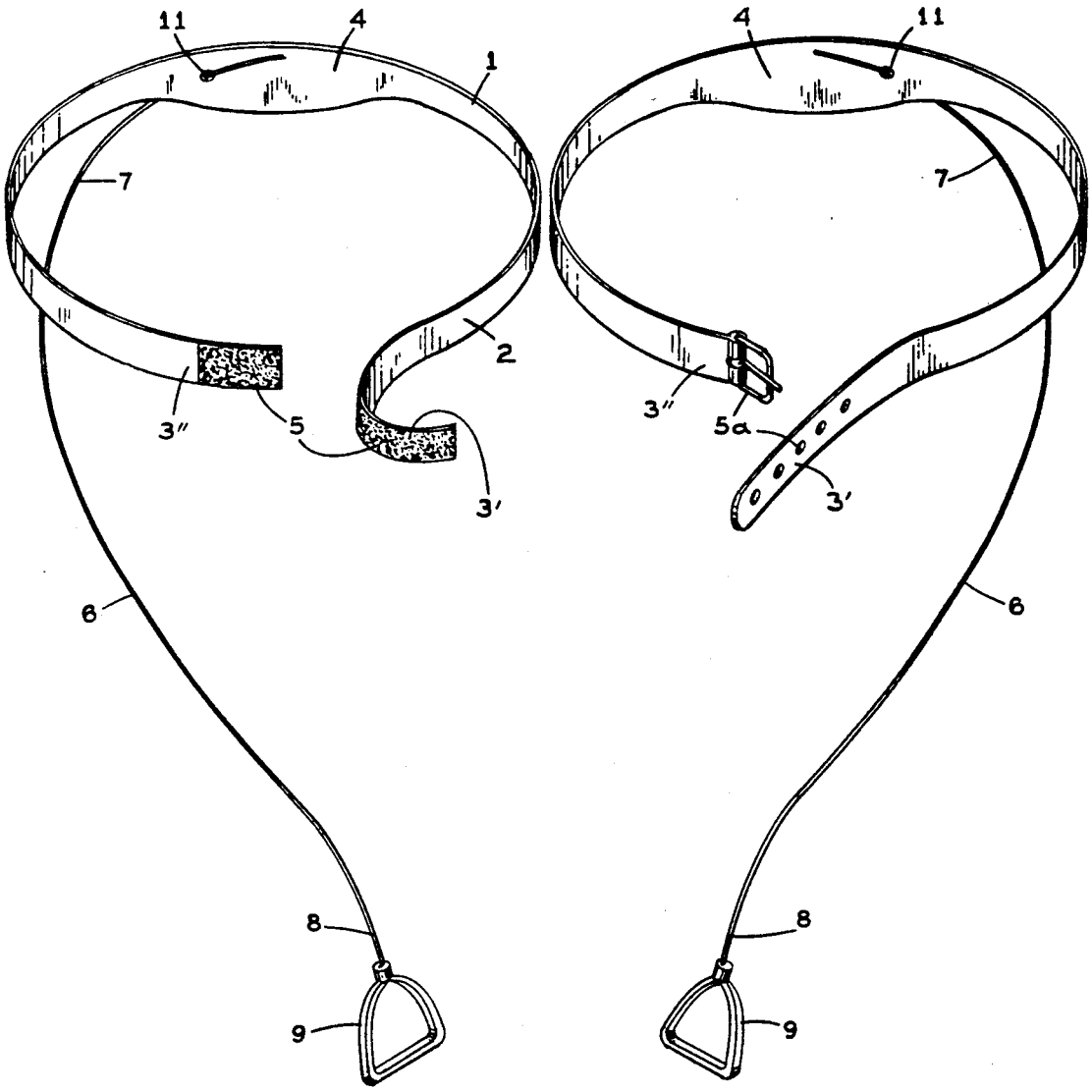
FIG. 1*a* is a perspective diagrammatic view of the invention as arranged for a right-handed player.
FIG. 1*b* is a perspective diagrammatic view of the invention as arranged for a left-handed player.

FIG. 1*a* shows the invention as arranged for a right-handed player, and FIG. 1*b* shows the invention as arranged for a left-handed player.

In FIG. 1*a* the hip belt 1 has a main belt strap 2 with opposite ends 3', 3" joined in a suitable joining arrangement, shown for example as a hook and loop connection 5, also known as VELCRO®. The joining arrangement can alternatively be any one of several known kinds of belt buckles. The back side of the belt has a widened section 4 that affords space for attachment of an elastic cord 6 having an upper end 7 attached in attachment point 11 to the widened belt section 4, and a lower end 8 attached to the stirrup 9 that serves to receive the one foot of the golf player.

The elastic cord 6 can be of the well-known "bungee" cord type with a core of rubber with a woven sheath encasing the rubber cord, or it may be a strap of rubber material. The belt strap may be made of any suitable material such as leather, or woven belt webbing material as known from safety belts, etc.

FIG. 1*b*, arranged for a left-handed player, has a construction as in FIG. 1*a*, except the elastic cord 6 is directed from the back to the left-hand side and bent to the right side to receive a right foot of a left-handed player.

As shown in the figures, the rear point of attachment for the elastic cord is substantially opposite the joining point of the belt ends 3', 3", in other words on the back of the player.

The stirrup 9 can be made of any suitable material such as molded plastic, or metal, e.g. aluminum, or the like.

Figure 2A:
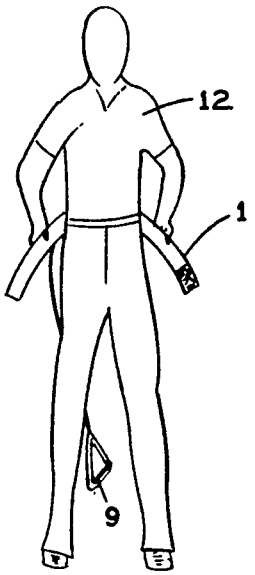
FIG. 2*a* is a diagrammatic view of a player putting on the belt according to the invention.
Figure 2B:
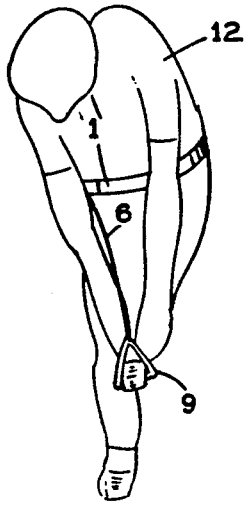
FIG. 2*b* is a diagrammatic view of a (right-handed) player placing the left foot in the stirrup.

In operation, FIGS. 2*a*–2*f* show the use of the invention as follows:

In FIG. 2*a*, the player 12 is strapping on the belt 1, and in FIG. 2*b* he has slung the elastic cord around his right side and is placing his left foot in the stirrup 9.

Figure 2C:
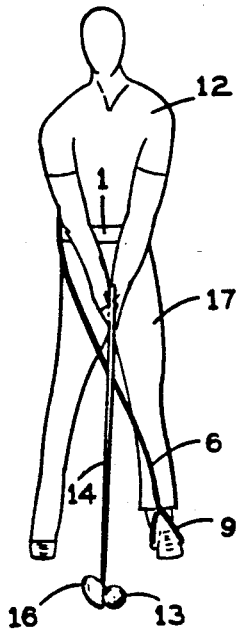
FIG. 2*c* is a diagrammatic view showing a player in a position addressing the ball with the elastic cord stretched on the right side.

In FIG. 2*c* the player 12 has taken a stance in which he is addressing the ball 12 with the club 14, having a head 16, in which the club head is placed proximal to the ball 13.

In this stance the player is in the upright position with the elastic cord 6 stretched around his right side and along the right side of the left leg 17, ready to begin the back swing of the club.

Figure 2D:
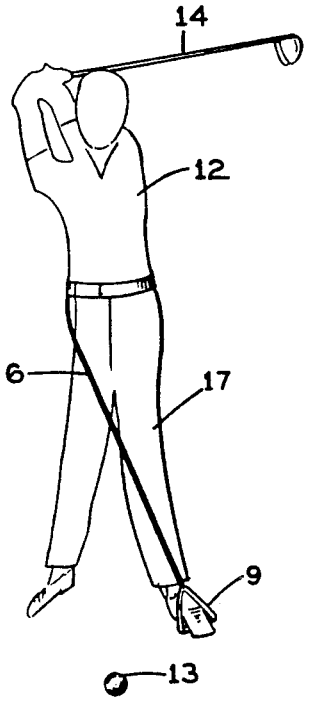
FIG. 2*d* is a diagrammatic view of the player in the extreme back swing stance.

In FIG. 2*d* the player is in the extreme back swing position with the hips turned the maximum angle to the right and the elastic cord stretched from the point of attachment behind the back of the player, with the right side of the player straight, ready to start the down swing. At the same time the left knee is urged inward by the elastic cord for the perfect take-away stance.

Figure 2E:
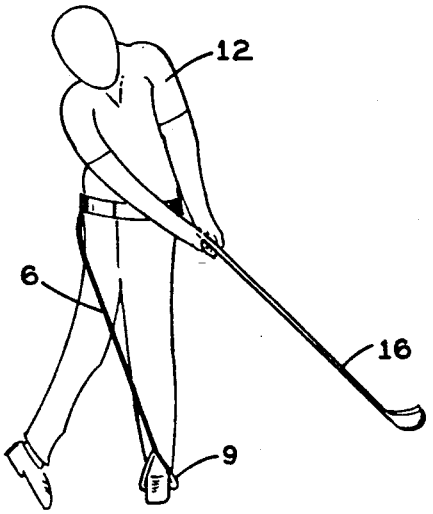
FIG. 2*e* is a diagrammatic view of the player in the down swing position rotating his hips through the ball aided by the elastic cord.
Figure 2F:
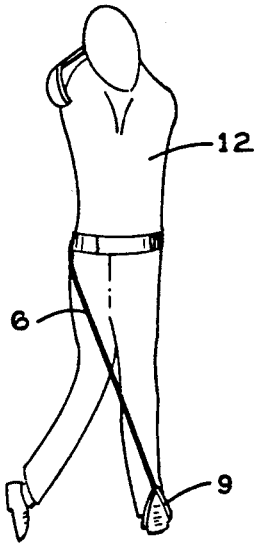
FIG. 2*f* is a diagrammatic view of the player having completed a swing with a full rotation of the hips.

FIG. 2*e* shows the position of the player in the down swing after hitting the ball with the club head 16. During the swing the player's body has been pulled in rotation of the hips through the swing, and in FIG. 2*f* the player has completed the swing with a full turn of rotation of the hips pulled around by the elastic cord.

FIGS. 2*a*–2*f* all relate to a right-handed player. For a left-handed player, all the figures would be symmetrical about the vertical center plane.

We claim:

1. A golf training device for a golf player comprising:

a hip belt having opposite belt ends, belt closing means on the belt for holding the belt ends in joined position over the front abdominal area of the player, an elastic cord having an upper end and a lower end, a stirrup attached to said lower end of the elastic cord for receiving a foot of the player, said elastic cord being attached to said belt at an attachment point on said belt located with respect to said closing means such that said attachment point is positioned over the lower back area and between the hips of the player when said closing means is positioned over said front abdominal area, the length of said cord being such that said elastic cord wraps laterally and upwardly from said stirrup receiving a foot of the player over the front and around to the rear of the player in a stretched condition creating a rotational torque at the hips of the player which assists the player in maintaining a proper body stance throughout the swing with a club and properly turning the hips as required for a proper swing.

2. A golf training device according to claim 1 including hook and loop fasteners in said belt closing means attached to respective opposite ends of said hip belt.

3. A golf training device according to claim 2, wherein said elastic cord has a length in the stretched condition substantially equal to the distance between the left foot of the player and said elastic cord attachment point with a right-handed player in a stance beginning the swing.

4. A golf training device according to claim 2, wherein said elastic cord has a length in the stretched condition substantially equal to the distance between the right foot of the player and said elastic cord attachment point with a left-handed player in a stance beginning the swing.

5. A method of assisting the swing of a golf player comprising the steps of:

attaching a belt around the hips of a player, placing a stirrup over a foot of the player, and connecting one end of an elastic cord to the stirrup and a second end of the cord to a point on the belt located over the lower back area and between the hips of the player, the length of said cord being such that said cord wraps laterally and upwardly from the front and around to the rear of the player in a stretched condition creating a rotational torque at the hips of the player which assists the player in maintaining a proper body stance throughout the swing with a club and properly turning the hips as required for a proper swing.

6. A method according to claim 5, wherein said placing step includes using the left foot of the player, and said connecting step includes wrapping the cord around the right hip of the player.

7. A method according to claim 5, wherein said placing step includes using the right foot of the player, and said connecting step includes wrapping the cord around the left hip of the player.

* * * * *